US005859304A

United States Patent [19]

Barchas et al.

[11] Patent Number: 5,859,304

[45] Date of Patent: Jan. 12, 1999

[54] CHEMICAL ABSORPTION PROCESS FOR RECOVERING OLEFINS FROM CRACKED GASES

[75] Inventors: Richard Barchas; Richard McCue, Jr.; Christopher Wallsgrove; Mark Whitney, all of Houston, Tex.

[73] Assignee: Stone & Webster Engineering Corp., Boston, Mass.

[21] Appl. No.: 764,974

[22] Filed: Dec. 13, 1996

[51] Int. Cl.[6] ..... C07C 7/10; C07C 7/148; F25J 3/00

[52] U.S. Cl. ..... 585/809; 585/844; 585/843; 585/845; 585/846; 585/848; 585/850; 585/860; 62/625; 62/632; 62/622; 62/935

[58] Field of Search ..... 585/833, 843, 585/844, 845, 846, 848, 850, 860, 809; 62/625, 632, 622, 935

[56] References Cited

U.S. PATENT DOCUMENTS

| | | | |
|---|---|---|---|
| 1,875,924 | 9/1932 | Horsley . | |
| 2,077,041 | 4/1937 | Davis et al. | 260/170 |
| 2,363,309 | 11/1944 | Freidman et al. | 260/677 |
| 2,377,221 | 5/1945 | Francis et al. | 260/669 |
| 2,391,404 | 12/1945 | Friedman et al. | 260/677 |
| 2,471,550 | 5/1949 | Shaw | 260/677 |
| 2,514,294 | 7/1950 | Rupp | 202/40 |
| 2,515,140 | 7/1950 | Strand | 260/677 |
| 2,523,681 | 9/1950 | Cole | 260/677 |
| 2,913,505 | 11/1959 | Van Raay et al. | 260/677 |
| 3,101,381 | 8/1963 | Baxter | 260/677 |
| 3,189,658 | 6/1965 | Quinn | 260/666 |
| 3,395,192 | 7/1968 | Long | 260/677 |
| 3,676,516 | 7/1972 | Haskell et al. | 260/677 |
| 3,679,763 | 7/1972 | Livingston | 260/677 |
| 3,756,036 | 9/1973 | Ezell | 62/28 |
| 3,758,603 | 9/1973 | Steigelmann et al. | 260/677 |
| 3,758,605 | 9/1973 | Hughes et al. | 260/677 |
| 3,763,200 | 10/1973 | Dines | 260/430 |
| 3,770,842 | 11/1973 | Steigelmann et al. | 260/677 |
| 3,773,844 | 11/1973 | Perry et al. | 260/669 |
| 3,787,514 | 1/1974 | Bernusset | 260/677 |
| 3,864,418 | 2/1975 | Hughes et al. | 260/677 |
| 3,865,890 | 2/1975 | Steigelmann et al. | 55/16 |
| 3,944,628 | 3/1976 | Suzuki et al. | 260/674 |
| 4,014,665 | 3/1977 | Steigelmann | 55/16 |
| 4,025,574 | 5/1977 | Tabler et al. | 260/677 |
| 4,060,566 | 11/1977 | Yahnke | 260/677 |
| 4,105,588 | 8/1978 | Balducci et al. | 252/454 |
| 4,121,917 | 10/1978 | Baker et al. | 62/28 |
| 4,132,744 | 1/1979 | Knifton | 260/677 |
| 4,147,353 | 4/1979 | Marcinkowsky et al. | 585/835 |
| 4,154,770 | 5/1979 | Kaplan | 585/332 |
| 4,174,353 | 11/1979 | Marcinkowsky et al. | 585/835 |
| 4,235,983 | 11/1980 | Steigelmann et al. | 526/68 |
| 4,328,382 | 5/1982 | Alter et al. | 585/844 |
| 4,347,392 | 8/1982 | Cosyns et al. | 585/259 |
| 4,398,052 | 8/1983 | Tabler et al. | 585/845 |
| 4,409,410 | 10/1983 | Cosyns et al. | 585/259 |
| 4,436,540 | 3/1984 | Dowd et al. | 62/30 |
| 4,484,015 | 11/1984 | Johnson et al. | 585/262 |
| 4,525,180 | 6/1985 | Hirai et al. | 55/37 |
| 4,546,094 | 10/1985 | Hirai et al. | 502/402 |
| 4,571,442 | 2/1986 | Cosyns et al. | 585/261 |
| 4,652,280 | 3/1987 | Boeren et al. | 55/67 |
| 4,747,855 | 5/1988 | Hirai et al. | 55/74 |
| 4,762,956 | 8/1988 | Liu et al. | 585/259 |
| 4,826,603 | 5/1989 | Hayes, Jr. | 210/635 |
| 4,864,071 | 9/1989 | Hirai et al. | 585/829 |
| 4,943,673 | 7/1990 | Norman et al. | 585/845 |
| 5,015,268 | 5/1991 | Ho | 55/16 |
| 5,057,641 | 10/1991 | Valus et al. | 585/818 |
| 5,059,732 | 10/1991 | Cosyns et al. | 585/259 |
| 5,062,866 | 11/1991 | Ho | 55/16 |
| 5,090,977 | 2/1992 | Strack et al. | 62/23 |
| 5,191,151 | 3/1993 | Eriksen et al. | 585/818 |
| 5,191,153 | 3/1993 | Cymbaluk et al. | 585/833 |
| 5,202,521 | 4/1993 | Brown et al. | 585/848 |
| 5,220,097 | 6/1993 | Lam et al. | 585/809 |
| 5,326,929 | 7/1994 | Mehra et al. | 585/809 |
| 5,365,011 | 11/1994 | Ramachandran et al. | 585/829 |
| 5,421,167 | 6/1995 | Verma | 62/24 |
| 5,444,176 | 8/1995 | Grenoble et al. | 585/809 |
| 5,452,581 | 9/1995 | Dinh et al. | 62/24 |
| 5,453,559 | 9/1995 | Phillips et al. | 585/809 |
| 5,510,550 | 4/1996 | Cheung et al. | 585/592 |
| 5,516,851 | 5/1996 | Flick et al. | 585/330.2 |
| 5,516,966 | 5/1996 | Nowack et al. | 585/848 |
| 5,523,512 | 6/1996 | Cymbaluk et al. | 585/848 |

FOREIGN PATENT DOCUMENTS

| | | | |
|---|---|---|---|
| 9404477 | 3/1994 | WIPO | C07C 5/05 |

OTHER PUBLICATIONS

Encyclopedia of Chemical Technology; Kirk–Othmer, second edition, vol. 8, pp. 510–514, 1965.

Encyclopedia of Chemical Technology; Kirk–Othmer, fourth edition, vol. 9, p. 877+, 1994.

*Primary Examiner*—Glenn Caldarola
*Assistant Examiner*—Thuan D. Dang
*Attorney, Agent, or Firm*—Hedman, Gibson & Costigan, P.C.

[57] ABSTRACT

The present invention provides an improved method for recovering high purity olefins from cracked gas effluents or other parafin/olefin gaseous mixtures by use of a chemical absorption process.

19 Claims, 3 Drawing Sheets

CHEMICAL ABSORPTION PROCESS FOR RECOVERING OLEFINS FROM CRACKED GASES

The present invention relates to a process for the recovery of olefins from cracked gases employing a chemical absorption process.

BACKGROUND OF THE INVENTION

The processes for converting hydrocarbons at high temperature, such as for example, steam-cracking, catalytic cracking or deep catalytic cracking to produce relatively high yields of unsaturated hydrocarbons, such as, for example, ethylene, propylene, and the butenes are well known in the art. See, for example, Hallee et al., U.S. Pat. No. 3,407,789; Woebcke, U.S. Pat. No. 3,820,955, DiNicolantonio, U.S. Pat. No. 4,499,055; Gartside et al., U.S. Pat. No. 4,814,067; Cormier, Jr. et al., U.S. Pat. No. 4,828,679; Rabo et al., U.S. Pat. No. 3,647,682; Rosinski et al., U.S. Pat. No. 3,758,403; Gartside et al., U.S. Pat. No. 4,814,067; Li et al., U.S. Pat. No. 4,980,053; and Yongqing et al., U.S. Pat. No. 5,326,465.

It is also well known in the art that these mono-olefinic compounds are extremely useful in the formation of a wide variety of petrochemicals. For example, these compounds can be used in the formation of polyethylene, polypropylenes, polyisobutylene and other polymers, alcohols, vinyl chloride monomer, acrylonitrile, methyl tertiary butyl ether and other petrochemicals, and a variety of rubbers such as butyl rubber.

Besides the mono-olefins contained in the cracked gases, the gases typically contain a large amount of other components such as diolefins, hydrogen, carbon monoxide and paraffins. It is highly desirable to separate the mono-olefins into relatively high purity streams of the individual mono-olefinic components. To this end a number of processes have been developed to make the necessary separations to achieve the high purity mono-olefinic components.

Plural stage rectification and cryogenic chilling trains have been disclosed in many publications. See, for example Perry's Chemical Engineering Handbook (5th Edition) and other treatises on distillation techniques. Recent commercial applications have employed technology utilizing dephlegmator-type rectification units in chilling trains and a reflux condenser means in demethanization of gas mixtures. Typical rectification units are described in Roberts, U.S. Pat. No. 2,582,068; Rowles et al., U.S. Pat. No. 4,002,042, Rowles et al., U.S. Pat. No. 4,270,940, Rowles et al., U.S. Pat. No. 4,519,825; Rowles et al., U.S. Pat. No. 4,732,598; and Gazzi, U.S. Pat. No. 4,657,571. Especially successful cryogenic operations are disclosed in McCue, Jr. et al., U.S. Pat. No. 4,900,347; McCue, Jr., U.S. Pat. No. 5,035,732; and McCue et al., U.S. Pat. No. 5,414,170.

In a typical conventional cryogenic separation process, as shown in FIG. 1, the cracked gas in a line 2 is compressed in a compressor 4. The compressed gas in a line 6 is then caustic washed in washer 8 and fed via a line 10 to dryer 12. The dried gas in a line 14 is then fed to the chilling train 16. Hydrogen and methane are separated from the cracked gas by partially liquefying the methane and liquefying the heavier components in the chilling train 16.

Hydrogen is removed from the chilling train 16 in a line 18 and methane is removed via a line 20, recompressed in compressor 24 and recovered in a line 26.

The liquids from the chilling train 16 are removed via a line 22 and fed to a demethanizer tower 28. The methane is removed from the top of the demethanizer tower 28 in a line 30, expanded in expander 32 and sent to the chilling train 16 as a refrigerant via a line 34. The $C_2$+ components are removed from the bottom of the demethanizer tower 28 in a line 36 and fed to a deethanizer tower 38. The $C_2$ components are removed from the top of the deethanizer tower 38 in a line 40 and passed to an acetylene hydrogenation reactor 42 for selective hydrogenation of acetylenes. The effluent from the reactor 42 is then fed via a line 44 to a $C_2$ splitter 46 for separation of the ethylene, removed from the top of splitter 46 in a line 48, and ethane, removed from the bottom of splitter 46 in a line 50.

The $C_3$+ components removed from the bottom of the deethanizer tower 38 in a line 52 are directed to a depropanizer tower 54. The $C_3$ components are removed from the top of the depropanizer tower in a line 56 and fed to a $C_3$ hydrogenation reactor 58 to selectively hydrogenate the methyl acetylene and propadiene. The effluent from reactor 58 in a line 60 is fed to a $C_3$ splitter 62 wherein the propylene and propane are separated. The propylene is removed from the top of the $C_3$ splitter in a line 64 and the propane is removed from the bottom of the $C_3$ splitter in a line 66.

The $C_4$+ components removed from the bottom of the depropanizer tower 54 in a line 68 are directed to a debutanizer 70 for separation into $C_4$ components and $C_5$+ gasoline. The $C_4$ components are removed from the top of the debutanizer 70 in a line 72 and the $C_5$+ gasoline is removed from the bottom of the debutanizer 70 in a line 74.

However, cryogenic separation systems of the prior art have suffered from various drawbacks. In conventional cryogenic recovery systems, the cracked gas is typically required to be compressed to about 450–600 psig, thereby requiring 4–6 stages of compression. Additionally, in conventional cryogenic recovery systems, four tower systems are required to separate the olefins from the paraffins: deethanizer, $C_2$ splitter, depropanizer and $C_3$ splitter. Because the separations of ethane from ethylene, and propane from propylene, involve close boiling compounds, the splitters generally require very high reflux ratios and a large number of trays, such as on the order of 100 to 250 trays each. The conventional cryogenic technology also requires multi-level cascaded propylene and ethylene refrigeration systems, as well as complicated methane turboexpanders and recompressors or a methane refrigeration system, adding to the cost and complexity of the conventional technology. It has also been studied in the prior art to employ metallic salt solutions, such as silver and copper salt solutions, to recover olefins, but none of the studied processes have been commercialized to date.

For example, early teachings regarding the use of copper salts included Uebele et al., U.S. Pat. No. 3,514,488 and Tyler et al., U.S. Pat. No. 3,776,972. Uebele et al. '488 taught the separation of olefinic hydrocarbons such as ethylene from mixtures of other materials using absorption on and desorption from a copper complex resulting from the reaction of (1) a copper(II) salt of a weak ligand such as copper(II) fluoroborate, (2) a carboxylic acid such as acetic acid and (3) a reducing agent such as metallic copper. Tyler et al. '972 taught the use of trialkyl phosphines to improve the stability of $CuAlCl_4$ aromatic systems used in olefin complexing processes.

The use of silver salts was taught in Marcinkowsky et al., U.S. Pat. No. 4,174,353 wherein an aqueous silver salt stream was employed in a process for separating olefins from hydrocarbon gas streams. Likewise, Alter et al., U.S. Pat. No. 4,328,382 taught the use of a silver salt solution such as silver trifluoroacetate in an olefin absorption process.

More recently, Brown et al., U.S. Pat. No. 5,202,521 taught the selective absorption of $C_2$–$C_4$ alkenes from $C_1$–$C_5$ alkanes with a liquid extractant comprising dissolved copper(I) compounds such as Cu(I) hydrocarbonsulfonate in a one-column operation to produce an alkene-depleted overhead, an alkene-enriched side stream and an extractant rich bottoms.

Special note is also made of Davis et al., European Patent Application EP 0 699 468 which discloses a method and apparatus for the separation of an olefin from a fluid containing one or more olefins by contacting the fluid with an absorbing solution containing specified copper(I) complexes, which are formed in situ from copper(II) analogues and metallic copper.

However, none of the prior art absorption processes have described a useful method of obtaining relatively high purity olefin components from olefin-containing streams such as cracked gases. The use of silver nitrate solutions while good at separating olefins from non-olefinic hydrocarbon gases has generally proved to be impractical at separating the olefins from one another. Moreover, the hydrogen contained in the process stream has proven to be detrimental due to the chemical reduction of the silver ions to metallic silver in the presence of hydrogen.

Regarding the copper absorption processes, none of the processes disclosed to date have proven sufficient to provide the high olefin purities for the petrochemical industry, i.e., polymer grade ethylene and propylene.

In a recently filed patent application assigned to the same assignee as the present application, Ser. No. 08/696,578, attorney docket no. 696-246, a system especially suited for the use of cuprous salts with buffering ligand (although silver salts and other metallic salts were also disclosed in connection therewith) was disclosed. Although the cuprous salt system provided several advantages over the prior art, the use of a system especially suitable for employing silver ions has certain further advantages. For example, unlike silver[+1] ions, cuprous ions are not stable and require a buffering ligand. Accordingly, various systems are required for preparing the buffered cuprous salt solution and for containing and recovering the ligand. Additionally, cuprous salts are not as soluble as silver salts, such as silver nitrate, thereby requiring a greater solution circulation rate and larger equipment. Although silver nitrate is considerably more expensive than its copper counterparts, it is contained in the system and can readily be recovered from spent solution.

Therefore, it would be highly desirable to provide a economical system which is especially suitable for the use of silver salts as the chemical absorbent.

SUMMARY OF THE INVENTION

It is therefore an object of the present invention to provide a process for the recovery of olefins which is sufficient to produce the olefins at high purity levels, i.e., polymer grade.

It is a further object of the present invention to provide a process for the recovery of high purity olefins which reduces the compressor requirements.

It is another object of the present invention to provide a process for the recovery of high purity olefins which eliminates the need for distillation separation of close boiling olefins and paraffins.

It is still another object of the present invention to provide a process for the recovery of high purity olefins which reduces refrigeration requirements.

It is another further object of the present invention to provide a process which substantially removes hydrogen from the process stream upstream of the chemical absorption step.

It is still another further object of the present invention to provide a process which is suitable for both grassroots and retrofit applications.

To this end, the present invention provides a process for the production of high purity olefin components employing an upstream partial demethanization system to remove substantially all of the hydrogen and at least a portion of the methane, a separation system based on the separation of olefins from paraffins employing selective chemical absorption of the olefins, desorption of the olefins from the absorbent, and separation of the olefins into high purity components by distillation, thereby overcoming the shortcomings of the prior art processes.

DETAILED DESCRIPTION OF THE PRESENT INVENTION

Figure 1:
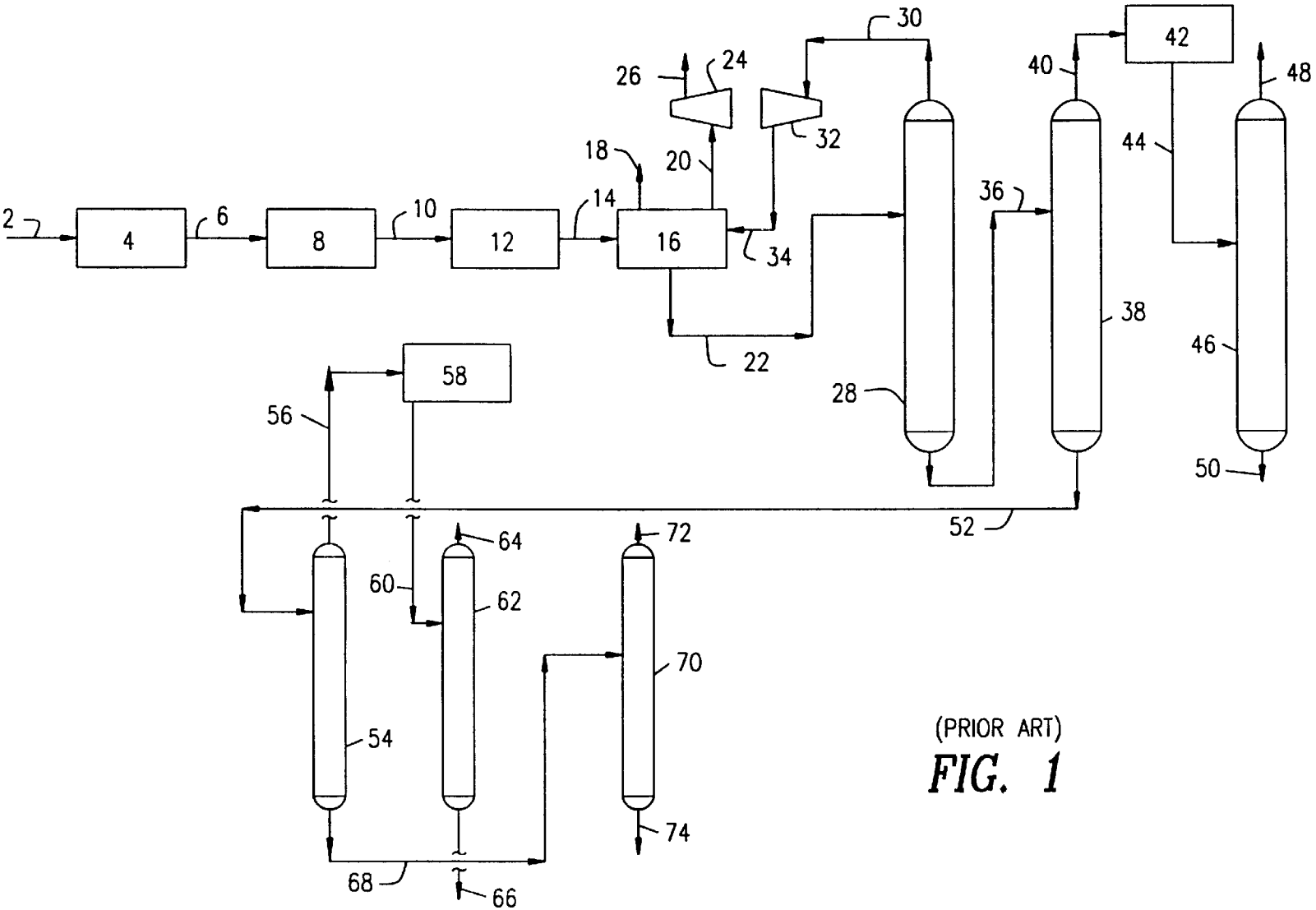
(PRIOR ART) FIG. 1
FIG. 1 depicts in flow chart manner a cryogenic process of the prior art.

The present invention provides a novel process for the recovery of olefins from cracked gases comprising the steps of (a) demethanizing the cracked gas stream to remove at least a portion of the methane and substantially all of the hydrogen from the cracked gas stream to produce a partially demethanized gas stream; (b) contacting the partially demethanized gas stream with a metallic solution capable of selectively chemically absorbing the ethylene and propylene to produce a stripped paraffin-rich gaseous stream and a chemically absorbed olefin-rich stream; and (c) recovering the olefins from the metallic chemical absorbent solution.

The cracked gas streams useful as feedstocks in the process of the present invention can typically be any gas stream which contains light olefins, namely ethylene and propylene, in combination with other gases, particularly, hydrogen and saturated hydrocarbons. Typically, cracked gas streams for use in accordance with the practice of the present invention will comprise a mixture of butane, butenes, propane, propylene, ethane, ethylene, acetylene, methyl acetylene, propadiene, methane, hydrogen, and carbon monoxide.

The cracked gas stream is preferably first compressed to a pressure ranging from about 100 psig to about 450 psig, preferably from about 250 psig to about 400 psig, in the compressing step to produce a compressed cracked gas stream. The compression may be effected in any compressor or compression system known to those skilled in the art. This relatively low compression requirement represents a significant improvement over the prior art cryogenic processes. In the prior art cryogenic process, the cracked gas is typically required to be compressed to about 450–600 psig and requires 4–6 stages of compression. In the present process, the compression requirements are significantly reduced thereby representing a significant savings.

The compressed gas is then caustic washed to remove hydrogen sulfide and other acid gases, as is well known to those skilled in the art. Any of the caustic washing processes known to those skilled in the art may be employed in the practice of the present invention.

The washed and compressed gas is then dried, such as over a water-absorbing molecular sieve to a dew point of from about −150° F. to about −200° F. to produce a dried stream. The drying serves to remove water before downstream chilling of the process stream.

The dried process stream is then preferably depropanized to recover butadiene and prevent heavier components from condensing in downstream equipment or fouling the front-end hydrogenation system. The depropanizer typically operates at pressures ranging from 50 psia to 300 psia and is normally equipped with a reboiler. Optionally, a dual depropanizer system may be employed, the first depropanizer operating at relatively high pressures, such as from about 150 to about 300 psia, and the second depropanizer operating at pressures ranging from about 50 to about 125 psia.

The bottoms from the depropanizer comprises substantially all of the $C_4$+ hydrocarbons including the butadiene which enhances the value of this stream. This stream may be separated into its component parts for butene recovery, butadiene recovery, pentene recovery, and recycling of the butanes and pentanes to the steam cracker, as desired. The embodiment of an upstream depropanizer system also eliminates the need for a gasoline decanting and wash system in the downstream absorption system.

The overhead from the depropanizer comprises substantially all of the $C_3$ and lighter hydrocarbons. This overhead stream is selectively hydrogenated to remove substantially all of the acetylenes and dienes contained therein, i.e., down to ppm levels. The presence of these compounds can adversely affect the stripping solution in the downstream absorption system. Thus, substantial removal of these compounds is preferable.

The hydrogenation system may employ any of the catalysts well known to selectively hydrogenate acetylene, methyl acetylene and propadiene. The Group VIII metal hydrogenation catalysts are the most commonly used and are preferred. The Group VIII metal hydrogenation catalysts are ordinarily associated with a support, such as alumina. One preferred catalyst is a low surface area granular alumina impregnated with about 0.1 weight percent palladium. Examples of other catalysts which can be used include Raney nickel, ruthenium-on-aluminum, nickel arsenide-on-aluminum, and the like and mixtures thereof. The catalysts ordinarily contain a Group VIII metal in an amount ranging from about 0.01 to about 1 percent by weight of the total catalyst. These and other catalysts are more fully disclosed in the literature. See for example, La Hue et al., U.S. Pat. No. 3,679,762; Cosyns et al., U.S. Pat. No. 4,571,442; Cosyns et al., U.S. Pat. No. 4,347,392; Montgomery, U.S. Pat. No. 4,128,595; Cosyns et al., U.S. Pat. No. 5,059,732 and Liu et al., U.S. Pat. No. 4,762,956.

The conditions employed in the acetylene hydrogenation reactor according to the present invention are typically more severe than those employed in the prior art front-end hydrogenation systems due to the desire to hydrogenate all of the methyl acetylene and propadiene as well as the acetylene. Typically three series reactors, incorporating lower space velocities (larger catalyst volumes) are generally required to achieve the "deeper" hydrogenation of the present invention. Generally, the selective hydrogenation process will be carried out over a temperature range of from about 50° C. to about 120° C., a pressure range of from about 100 psia to about 400 psia, and space velocities ranging from about 2000 $hr^{-1}$ to about 4000 $hr^{-1}$. Excess hydrogen, above the stoichiometric requirements for the selective hydrogenation reactions, is contained in the feed to the deep hydrogenation reactor. The process can be carried out employing the catalyst in a fixed bed or other type of contacting means known to those skilled in the art.

The effluent from the acetylene hydrogenation reactor is directed to a demethanization zone. Although the demethanization zone may comprise a conventional substantial demethanization system, it is preferred that in the practice of the present invention, only partial demethanization is effected. Conventional demethanization processes typically require total demethanization so that a clean $C_2$ fraction can be produced via distillation, for further separation into ethylene and ethane. However, in the practice of the present invention which includes a chemical absorption step, complete demethanization is not necessary because the olefins will be selectively absorbed from the methane in the selective chemical absorption system.

During the partial demethanization, hydrogen will be nearly completely removed as it boils substantially below methane. The removal of hydrogen from the cracked gas at this point in the process is advantageous in that it enables the use of concentrated aqueous silver nitrate solution as the chemical absorbent. The presence of hydrogen generally acts to reduce silver[+1] ions to metallic silver.

Thus, although a conventional demethanization system may be employed in the practice of the present invention, the economic advantages associated with a partial demethanization system, i.e., lower refrigeration and equipment costs, make the partial system preferable.

The liquids from the demethanization zone containing the $C_{2-3}$ hydrocarbon components and the residual portion of the methane are then vaporized and passed to the selective chemical absorption system of the present invention.

In the absorption section the $C_2/C_3$ vapor stream from the demethanizer system is scrubbed in an absorption tower with a scrubbing solution to separate the paraffins from the olefins. The olefins and residual diolefins are chemically complexed with the scrubbing solution and are removed from the paraffinic components. The scrubbed gases, mainly paraffins and any residual hydrogen, are removed from the top of the absorber. The olefins complexed with the scrubbing solution are removed from the bottom of the absorber.

The absorption tower may have any suitable number of theoretical stages, depending upon the composition of the gaseous mixture to be treated, the purity required for the ethylene and propylene and the type of complexing solution employed. The absorber preferably operates with the pressure typically at about 100 psig and the temperature maintained as low as practical without the need for refrigeration, for example from about 25° to about 35° C.

The scrubbing solution may contain an aqueous solution of any of a number of certain heavy metal ions which are known to form chemical complexes with olefins, e.g., copper(I), silver(I), platinum(II) and palladium(II). Especially useful in the practice of the present invention is a solution of a silver[+1] salt. The silver[+1] salts which are generally useful include, but are not limited to, silver[+1] acetate, silver[+1] nitrate and silver[+1] fluoride, and mixtures of any of the foregoing. Preferred for use in the present invention is silver[+1] nitrate.

Where copper is employed as the metallic salt, it is preferably employed in solution form buffered with a soluble organic nitrogen ligand, such as pyridine, piperidine, hydroxypropionitrile, diethylene triamine, acetonitrile, formamide and acetamide, derivatives thereof and mixtures of any of the foregoing. See, generally, Davis et al., EP '468. Especially preferred is pyridine and/or hydroxypropionitrile.

The concentration of silver[+1] salt in the aqueous scrubbing solution is at least about 0.5 moles of salt per liter of solvent, and preferably at least about 2 moles of salt per liter of solvent.

The absorbers of the present invention may further comprise a water wash section in the upper portion of the absorber and a prestripping zone in the lower section of the absorber. In the water wash section, water is added to the top of the absorber tower to reduce entrainment of the scrubbing solution.

In the prestripper section, at least a portion of the scrubbing solution containing the metallic salt:olefin complex is fed to a reboiler for heating to a temperature of from about 40° C. to about 60° C., preferably from about 45° C. to about 55° C. to desorb at least a substantial portion of any physically absorbed paraffins. Inexpensive quench water may be conveniently used as the heating medium as well as any other heating means known to those of ordinary skill in the art.

The bottoms of the absorber containing the metal salt:olefin complex is removed for scrubbing solution recovery and olefin component purification. In the first step of the further processing, the scrubbed liquid stream is fed to an olefin stripper for separation into an olefin rich gas stream and a spent scrubbing liquid stream.

In the olefin stripper, the desorption is effected, preferably in a packed tower or flash drum, by dissociating the olefins from the metal salt complexes using a combination of increased temperature and lower pressure. At temperatures ranging from about 65° C. to about 110° C., preferably from about 70° C. to about 85° C., and pressures ranging from about 5 psig to about 50 psig, the ethylene and propylene readily dissociate from the metal salt complexes. Inexpensive quench water can conveniently be used as the heating medium for olefin stripper temperatures in the lower end of the range, as well as any other heating means known to those of ordinary skill in the art. The olefin stripper is preferably equipped with a water wash section in the top of the stripper to prevent entrainment of the scrubbing solution with the desorbed gases.

It is understood that the olefin stripper or flash drum can comprise multi-stage stripping or flashing for increased energy efficiency. In such systems, the rich solution is flashed and stripped at progressively higher temperatures and/or lower pressures. The design of such systems is well known to those skilled in the art.

The stripped scrubbing solution is removed from the olefin stripper for reclaiming and recycling. All or a portion of the stripped solution may be passed via a slip stream to a reclaimer for further concentration. The reclaimer typically operates at a higher temperature than the olefin stripper. Typically, the temperature in the reclaimer ranges from about 100° C. to about 150° C., preferably from about 120° C. to about 140° C. The pressure ranges from about 5 psig to about 50 psig, preferably from about 10 psig to about 30 psig. The heating duty may be supplied by steam or any other means known to those skilled in the art. At these higher temperatures, residual acetylenes and diolefins are dissociated from the metal salt complexes.

Where a metal salt/ligand complex is employed in the chemical absorbing solution, a ligand recovery system may be employed as described in commonly assigned, copending U.S. patent application Ser. No. 08/696,578, attorney docket no. 696-246.

The stripped olefins from the olefin stripper are compressed to about a pressure ranging from about 250 psig to about 300 psig, preferably about 300 psig. A two stage centrifugal compressor is typically suitable for this compression, although other means known to those skilled in the art may be employed. The compressed olefins are then dried and fractionated in a deethylenizer.

The dried mixed olefins are fed to a deethylenizer tower which operates at a pressure ranging from about 250 psig to about 300 psig, generally about 275 psig. Typically, low level propylene refrigeration is sufficient for feed chilling and to condense the overheads in the deethylenizer. Quench water or other suitable means may be employed for reboiling. Polymer-grade ethylene is taken at or near the top of the deethylenizer. A small vent containing residual methane and hydrogen may also be taken off the top of the tower or reflux drum. Polymer grade propylene is removed from the bottom of the deethylenizer.

Alternatively, the mixed olefin stream could be dried, and fractionated in the deethylenizer tower incorporating a heat pump. In this embodiment, the deethylenizer overhead (ethylene product) is compressed and condensed in the reboiler. Again, polymer-grade propylene is taken as the bottoms product of the deethylenizer.

Conventionally, the recovery of polymer-grade ethylene and propylene via distillation was a very expensive proposition due to the difficulty of separating close boiling compounds via distillation. In the $C_2$ splitter, ethylene was separated from ethane, and in the $C_3$ splitter propylene was separated from propane. A large number of trays (about 100–250 for each splitter) and high reflux ratios were required for these separations. Additionally, large quantities of energy in the form of steam, hot water, refrigeration and cooling water were required for the operation of these splitters.

However, the present invention employing the chemical absorption system, enables the separation of paraffins from olefins without respect to carbon number. Thus, the olefins are first separated from the paraffins in the chemical absorption process. The olefins are then relatively easily separated from each other using conventional distillation due to their relatively wide boiling point differences. Low reflux ratios and a small number of trays are sufficient to produce polymer-grade ethylene and propylene products. For example, a 70 tray deethylenizer tower operating at a reflux ratio of 1.5 is generally sufficient to produce polymer-grade ethylene and propylene in a single tower.

DESCRIPTION OF THE PREFERRED EMBODIMENTS

Figure 2:
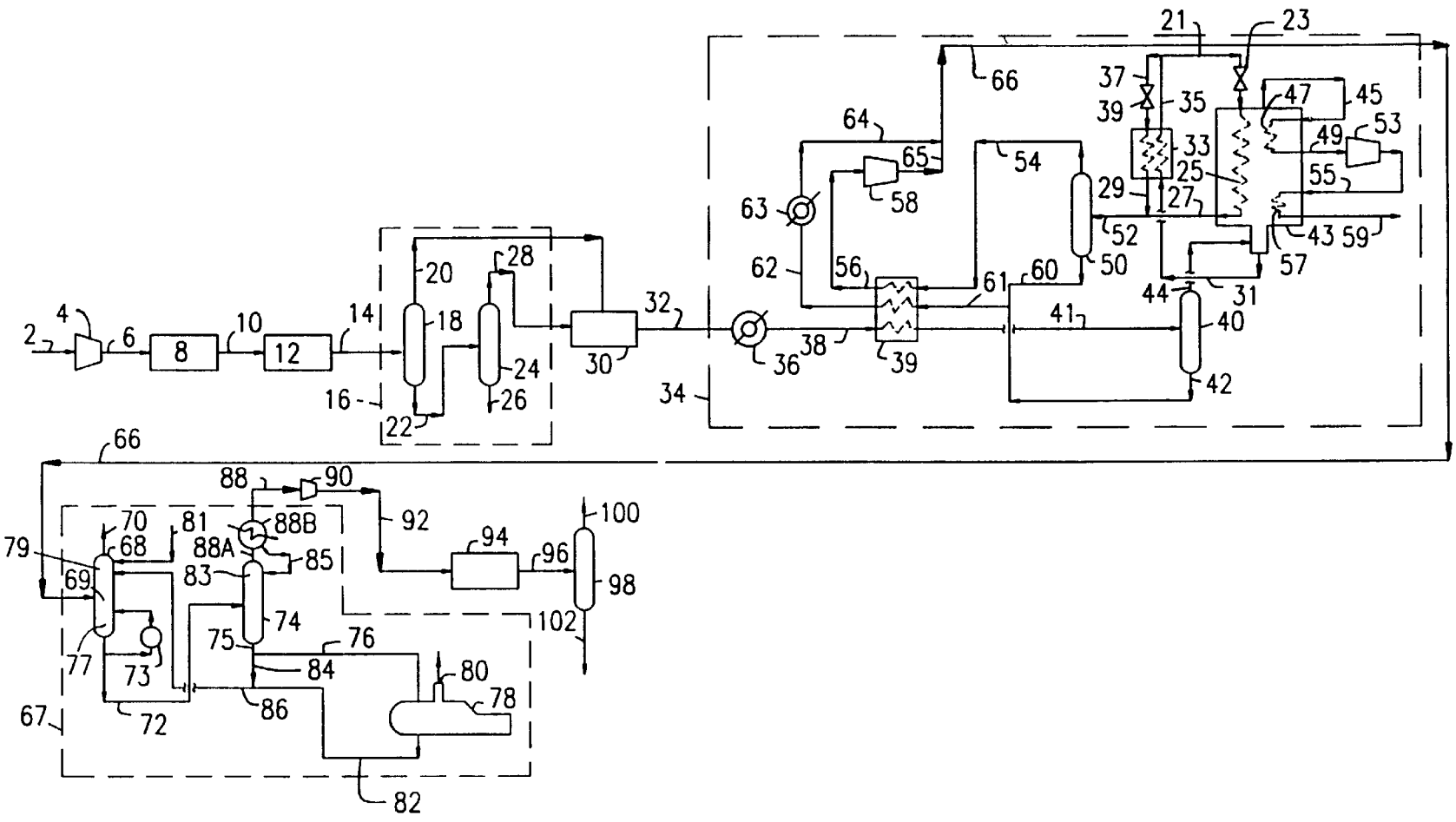
FIGS. 2 and 2A depict in flow chart manner embodiments of the process of the present invention.

Referring to FIG. 2, a mixed gaseous hydrocarbon stream, such as a cracked gas stream, in a line 2 is fed to a compressor 4 which operates to compress the gas stream to a pressure of about 300 psig. The compressed gaseous stream in a line 6 is caustic washed in caustic washer 8 and fed to a drier 12 via a line 10. The dried gas stream in a line 14 is then fed to a depropanizer system 16.

In the depropanizer system 16 the dried gas stream 14 enters a first high pressure depropanizer 18 operating at a pressure of about 250 psig to produce a first $C_3$ and lighter hydrocarbon overhead stream in a line 20 and a first $C_4$ and heavier bottoms stream in a line 22. The line 22 is then fed to a low pressure depropanizer 24 operating at a pressure of about 100 psig to separate the residual $C_3$ and lighter hydrocarbons in an overhead line 28 from the $C_4$ and heavier hydrocarbons in a line 26. The $C_4$ and heavier hydrocarbons in a line 26 may then be further processed as desired (not shown).

The first $C_3$ and lighter hydrocarbon overhead stream 20 and the residual $C_3$ and lighter hydrocarbon overhead stream 28, leave the depropanizer system 16 and are fed to a selective hydrogenation system 30. In the selective hydrogenation system, preferably three serially connected reactors, substantially all of the acetylene, methyl acetylene and propadiene are hydrogenated to the corresponding olefin. The selectively hydrogenated process stream in a line 32 then enters the demethanizer system 34.

In the demethanizer system 34 the process stream 32 is chilled and partially condensed in a chiller 36 to a temperature ranging from about −30° C. to about −40° C., preferably to about −35° C., using propylene refrigeration. The chilled effluent in a line 38 is then further chilled to about −45° C. and partially condensed in exchanger 39. The chilled stream in a line 41 is then fed to a separator 40 for separation into an overhead gaseous stream containing substantially all of the hydrogen, a portion of the methane and a portion of the $C_{2-3}$ hydrocarbons in a line 44. The liquid condensate comprising a portion of the $C_{2-3}$ hydrocarbons and a minor portion of the methane is removed via a bottoms line 42.

The overhead line 44 is then fed to a demethanizer tower or refluxed exchanger 43, where at least substantially all of the hydrogen and a major portion of the methane are removed from the top of the refluxed exchanger 43 via a line 45. The gaseous stream in line 45 is at a temperature of about −115° C. and provides refrigeration to exchanger 47 of refluxed exchanger 43. The gaseous stream exits the exchanger 47 as a warmed gaseous stream in a line 49 at a temperature of about −100° C. The warmed gaseous stream in a line 49 is then expanded to a temperature of about −145° C. in expander 53 and warmed again in exchanger 57 of refluxed exchanger 43 to a temperature of about −60° C. The warmed stream leaving exchanger 57 in a line 59 can be recovered, or optional, additional refrigeration can be recovered from this stream before sending it to the fuel gas header (not shown).

The liquid bottoms from the refluxed exchanger 43 comprising mostly $C_{2-3}$ hydrocarbons and some methane is removed via a line 31 and cooled in exchanger 33. The stream leaves exchanger 33 in a line 35 and is split into two streams. One of the split streams in a line 37 is flashed across a valve 39 and partially vaporized in exchanger 33 and exits in a line 29. The other stream in a line 21 is flashed across a valve 23 and partially vaporized in exchanger 25 of refluxed exchanger 43 and exits in a line 27. The two partially vaporized streams in lines 27 and 29 are combined into a line 52 and fed to a separator 50. The overhead exits the separator 50 in a line 54 at a temperature of about −70° C. The overhead is then warmed to a temperature of about −40° C. in exchanger 39 and leaves exchanger 39 in a line 56. The warmed vapor in a line 56 is then compressed in a compressor 58.

The liquid from separator 50 in a line 60 is combined with the liquid in a line 42 to form a line 61 for partial vaporization in exchanger 39. The mixture leaving the exchanger 39 in a line 62 is then totally vaporized in vaporizer 63 by condensing propylene refrigerant. The vapor leaving the vaporizer 63 in a line 64 is combined with the compressed vapor in a line 65 to form a combined vapor stream in a line 66 comprising essentially all of the $C_{2-3}$ hydrocarbons, some methane and trace amounts of hydrogen. This combined stream in a line 66 is then sent to the absorption system 67.

The propylene refrigerant in exchanger 36 is the only external refrigeration used in the partial demethanizer system 34 shown in FIG. 2. About 80% of the methane and essentially all of the hydrogen is removed from the cracked gas stream by this system 34. Preferably the demethanizer system of the present invention provides for nearly total removal of the hydrogen from the process stream and for up to 90 wt % removal of the methane from the process stream. The fuel gas stream leaving the demethanizer preferably contains less than 1 wt % of the ethylene contained in the feed.

In the absorption system, the $C_3$ and lighter hydrocarbon vapors in the line 66 are fed into a middle scrubbing section 69 of an absorber tower 68 operating at a pressure ranging from about 50 psig to about 200 psig, preferably about 100 psig. In the scrubbing section 69 of absorber tower 68 the feed is scrubbed with a scrubbing solution which enters near the top of the tower 68 via a line 86. The active metal complex, preferably silver nitrate, in the scrubbing solution chemically absorbs at least a substantial portion of the olefin components and directs them toward a bottom prestripping section 77 of the tower 68. The paraffin gases are not chemically absorbed by the active metal complex and rise to the top of the tower to a water wash section 79 where they are water washed with water entering via a line 81 to recover any entrained scrubbing solution. The paraffins and hydrogen gases are removed out of the top of tower 68 via an offgas line 70. This absorber offgas stream is conveniently recycled to the cracking furnaces.

The scrubbing solution containing the chemically absorbed olefins proceeds downward through the tower 68 and enters a pre-stripping section 77 wherein the scrubbing solution is reboiled with a reboiler 73 heated by quench water (not shown) to desorb any physically absorbed paraffins. (If the physically absorbed paraffins can be tolerated in the olefin products, the reboiler can be eliminated.) The scrubbed liquid comprising the ethylene and propylene and substantially free of paraffins is removed from the bottom of tower 68 via a stream 72.

The scrubbed liquid rich in olefins in a stream 72 is directed next to an olefin stripper 74 (or optionally a flash drum or series of flash drums) for desorption of the olefins from the spent scrubbing liquid using a combination of increased temperature and lower pressure as described hereinabove. The dissociated olefins are washed in an upper water wash section 83 of olefin stripper 74 which is supplied with water via a line 85 to recover any entrained spent scrubbing liquid. The stripped gas stream rich in olefins issuing from the olefins stripper 74 is removed via a line 88A and cooled in condenser 88B. Condensed water in a line 85 is sent to the olefin stripper as described hereinabove. The cooled stripped gas is removed via a line 88 for further processing into ethylene and propylene component rich product streams as described hereinbelow.

The lean scrubbing solution is removed from the bottom of the olefin stripper via a line 75. At least a portion of the solution in a slipstream line 76 is preferably directed to a reclaimer 78 for desorption of residual acetylenes and diolefins from the spent scrubbing solution at higher temperatures and pressures than those employed in the olefin stripper 74. The desorbed components exit the reclaimer via a vent line 80 and the reclaimed scrubbing solution is removed from the reclaimer 78 via a line 82.

The reclaimed scrubbing solution in a line 82 is merged with the other portion of the stripper bottoms in a line 84 to form a scrubbing solution recycle line 86 for recycling to the absorber tower 68.

The stripped gas stream rich in olefins issuing from the olefins stripper 74 in a line 88 is directed to an olefin compressor 90 for compression to a pressure ranging from about 200 psig to about 300 psig. The compressed olefin rich stream is removed from the compressor 90 in a line 92 for feeding to a dryer 94 operating at about 300 psig and about 40° C. The dried compressed olefin rich stream in a line 96 is then fed to a deethylenizer tower 98.

In the deethylenizer tower 98 which operates at from about 250 psig to about 300 psig, preferably about 275 psig, polymer grade ethylene is removed from a line near the top of the tower 98 as ethylene-rich product stream 100. Residual methane and hydrogen may optionally be removed via a vent line at the top of the tower or reflux drum (not shown). Polymer grade propylene is then removed from the bottom of the tower 98 as polymer-grade product stream 102.

Figure 2A:
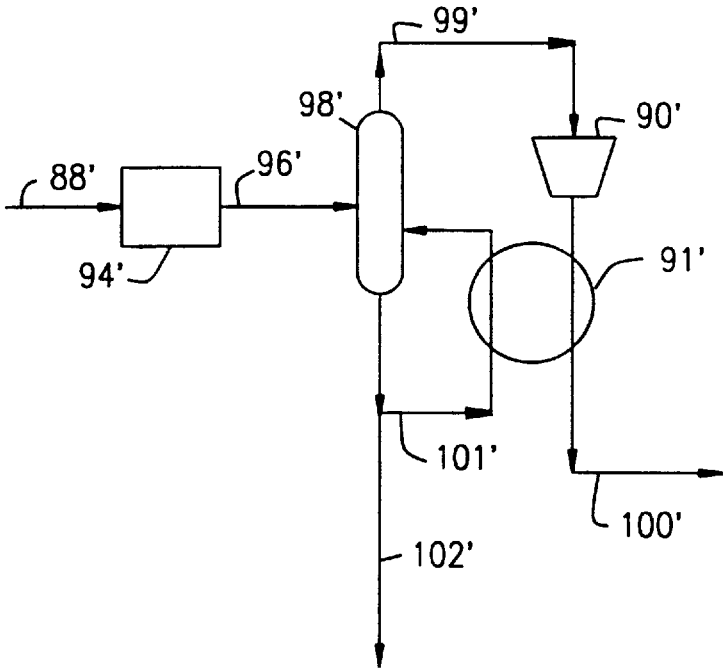

Many variations of the present invention will suggest themselves to those skilled in the art in light of the above-detailed description. For example, any of the known hydrogenation catalysts can be employed. Further, the reactor can be of the fixed bed type or other configurations useful in selective hydrogenation processes. Silver salts other than silver nitrate may be employed in chemically selectively absorbing olefins from olefin/paraffin gaseous mixtures. As seen in FIG. 2A, an optional deethylenization system may be employed wherein the ethylene and propylene rich stream from the olefin stripper (not shown) in a line 88' is first directed to an olefin dryer 94'. The dried olefins in a line 96' are then fed to the deethylenizer tower 98' equipped with reboiler 91' for separation. A line 99' withdrawn near the top of the deethylenizer containing polymer-grade ethylene in a line 99' is compressed in compressor 90' to produce a stream 100' which is first employed as the indirect heating means for reboiler 91'. The propylene product is reboiled in reboiler 91' via a line 101' and polymer-grade propylene product is recovered in a line 102'.

In retrofit embodiments, a parallel cracked gas recovery system of the present invention may be added to the existing conventional separation system to expand total capacity. In general, in an expansion case, some of the existing equipment would be retrofitted (e.g., gas compressor, caustic system, cracked gas dryers) and some equipment added as new (e.g., front end hydrogenation, partial demethanization, absorber/stripper system and deethylenizer). In addition, any stream within an existing olefins plant which is essentially free of acetylenes and $C_4$+ material, and is low in methane and very low in hydrogen could potentially be used as feed to the absorber. All such obvious modifications are within the full intended scope of the appended claims.

All of the above-referenced patents, patent applications and publications are hereby incorporated by reference.

We claim:

1. A process for the recovery of olefins from a cracked gas stream comprising ethylene, propylene, hydrogen, methane, ethane, acetylenes, dienes and heavier hydrocarbons, said process comprising the steps of:

(a) partially demethanizing said cracked gas stream to remove substantially all of said hydrogen from said cracked gas stream to produce a gaseous stream comprising hydrogen and from 15 to 90% of the methane contained in said cracked gas stream and a partially demethanized stream comprising the residual methane and heavier components;

(b) contacting said partially demethanized gas stream comprising said residual methane and heavier components with a solution of a metallic salt capable of selectively chemically absorbing the ethylene and propylene to produce a scrubbed paraffin-rich gaseous stream and a chemically absorbed olefin-rich liquid stream; and (c) recovering said olefins from said metallic chemical absorbent solution.

2. A process as defined in claim 1 wherein said process comprises compressing said cracked gas stream prior to said partial demethanization step.

3. A process as defined in claim 2 wherein said compression step comprises compressing said cracked gas stream to a pressure ranging from about 250 psig to about 400 psig.

4. A process as defined in claim 2 further comprising caustic washing the compressed cracked gas stream prior to partial demethanization to at least substantially remove any acid gases contained in said compressed cracked gas stream.

5. A process as defined in claim 4 further comprising drying the caustic washed compressed cracked gas stream prior to partial demethanization to at least substantially remove any water contained in said caustic washed compressed cracked gas stream.

6. A process as defined in claim 5 further comprising depropanizing the dried caustic washed compressed cracked gas stream prior to partial demethanization to at least substantially remove all of the $C_4$ and heavier hydrocarbons from said dried caustic washed compressed cracked gas stream.

7. A process as defined in claim 6 further comprising selectively hydrogenating substantially all of the acetylene, methyl acetylene and propadiene in the depropanized gas stream prior to partial demethanization.

8. A process as defined in claim 7 wherein said partial demethanization comprises the steps of:

(i) chilling said depropanized gas stream to a temperature ranging from about −30° C. to about −60° C. to partially condense out the $C_{2+}$ components;

(ii) separating the condensed $C_{2+}$ components from the chilled gaseous stream;

(iii) partially demethanizing said chilled gaseous stream to produce a fuel gas comprising primarily all of said hydrogen from said cracked gas stream and from 15 to 90% of said methane from said cracked gas stream with small amounts of ethylene and ethane, and a bottoms stream comprising primarily $C_{2+}$ components with residual methane;

(iv) expanding said fuel gas stream to provide refrigeration for the partial demethanization step;

(v) flashing the partially demethanized bottoms liquid to provide refrigeration for the partial demethanization and separating the flashed bottoms into a flashed vapor stream and a flashed liquid stream;

(vi) combining the chilled liquid stream from step (ii) with the flashed liquid stream and vaporizing said combined stream;

(vii) compressing the flashed vapor stream and combining said flashed vapor stream with said combined vaporized liquid stream to form said partially demethanized gas stream.

9. A process as defined in claim 2 wherein olefin recovery step (c) comprises the steps of:

(i) scrubbing said partially demethanized gas stream in an absorber tower with a scrubbing solution comprising a metallic salt to form a scrubbed gaseous stream rich in paraffins and hydrogen and a rich aqueous liquid stream rich in olefins;

(ii) stripping said rich liquid stream in an olefin stripper to produce a stripped gas stream rich in olefins and a lean liquid stream;

(iii) separating said stripped gas stream rich in olefins into an ethylene-rich product stream and a propylene-rich product stream.

10. A process as defined in claim 9 wherein said scrubbing solution comprises an aqueous solution of heavy metal ions selected from the group consisting of copper(I), silver(I), platinum(II) and palladium(II).

11. A process as defined in claim 10 wherein said scrubbing solution comprises a solution of aqueous silver nitrate.

12. A process as defined in claim 9 wherein said absorber tower comprises an upper water wash section for washing said scrubbed gaseous stream to remove residual scrubbing solution.

13. A process as defined in claim 9 wherein said olefin stripper comprises an upper water wash section for washing said stripped gas stream rich in olefins to remove residual scrubbing solution.

14. A process as defined in claim 9 further comprising recovering and recycling said lean liquid stream as said scrubbing liquid.

15. A process as defined in claim 14 wherein said recovery and recycling comprises recovering the lean liquid stream from said stripper, passing at least a portion of said lean liquid stream through a reclaimer to desorb any residual strongly absorbed compounds, and recycling at least a portion of the reclaimed liquid stream as said scrubbing liquid.

16. A process as defined in claim 9 wherein said step of separating ethylene from propylene comprises compressing said stripped gas stream rich in olefins to produce a compressed stripped gas stream rich in olefins, drying said compressed stripped gas stream rich in olefins to produce a dried compressed stripped gas stream rich in olefins and separating said dried compressed stripped gas stream rich in olefins in a deethylenizer tower into an ethylene-rich product stream and a propylene-rich product stream.

17. A process as defined in claim 9 wherein said step of separating ethylene from propylene comprises drying said stripped gas stream rich in olefins to produce a dried stripped gas stream rich in olefins, separating said dried stripped gas stream rich in olefins in a deethylenizer to tower to produce an overhead product stream rich in ethylene and a bottoms product stream rich in propylene, compressing said ethylene product stream, removing a portion of said propylene product stream for reboiling, and employing said compressed ethylene product stream as an indirect heat source for said deethylenizer reboiler.

18. A process as defined in claim 9 wherein step (i) further comprises reboiling at least a portion of said rich aqueous liquid stream to remove at least a portion of residual paraffins.

19. A process for debottlenecking and/or retrofitting an existing conventional olefins recovery process comprising removing at least a portion of a dried, essentially acid gas free and compressed cracked gas stream comprising ethylene, propylene, methane, ethane, acetylenes, dienes and heavier hydrocarbons, and processing said removed gas stream in a debottlenecking and/or retrofitting olefin recovery process comprising the steps of:

(i) depropanizing said removed gas stream to at least substantially remove all of the $C_4$ and heavier hydrocarbons from said removed gas stream to produce a depropanized removed gas stream;

(ii) selectively hydrogenating substantially all of the acetylene, methyl acetylene and propadiene in the removed depropanized gas stream to produce a hydrogenated removed gas stream;

(iii) partially demethanizing said hydrogenated removed gas stream to remove substantially all of said hydrogen from said cracked gas stream to produce a gaseous stream comprising hydrogen and from 15 to 90% of the methane contained in said hydrogenated removed gas stream and a partially demethanized stream comprising the residual methane and heavier components;

(iv) contacting said partially demethanized stream with a solution of a metallic salt capable of selectively chemically absorbing the ethylene and propylene to produce a scrubbed paraffin-rich gaseous stream and a chemically absorbed olefin-rich liquid stream; and (v) recovering said olefins from said metallic chemical absorbent solution.

* * * * *